US007818928B2

(12) United States Patent
Brunt et al.

(10) Patent No.: US 7,818,928 B2
(45) Date of Patent: Oct. 26, 2010

(54) CONDUIT DRAIN

(75) Inventors: Michael Brunt, Newmarket (CA); Wayne Gooderham, Etobicoke (CA)

(73) Assignee: Flexmaster Canada Ltd. (CA)

( * ) Notice: Subject to any disclaimer, the term of this patent is extended or adjusted under 35 U.S.C. 154(b) by 858 days.

(21) Appl. No.: 11/368,829

(22) Filed: Mar. 6, 2006

(65) Prior Publication Data

US 2006/0205336 A1 Sep. 14, 2006

Related U.S. Application Data

(60) Provisional application No. 60/660,042, filed on Mar. 8, 2005.

(51) Int. Cl.
*E04H 12/28* (2006.01)

(52) U.S. Cl. ..... 52/218; 52/219; 52/169.5

(58) Field of Classification Search ..... 52/596, 52/169.5, 16, 19, 20, 218, 219; 137/312, 137/343, 357; 202/205, 83; 439/461; 454/41; 29/890.3

See application file for complete search history.

(56) References Cited

U.S. PATENT DOCUMENTS

| | | | | | |
|---|---|---|---|---|---|
| 2,372,707 | A * | 4/1945 | Blome | 454/35 |
| 2,916,983 | A * | 12/1959 | Kinkead | 454/8 |
| 3,860,274 | A * | 1/1975 | Ledstrom et al. | 285/312 |
| 4,182,376 | A * | 1/1980 | Nilsson | 137/874 |
| 4,407,526 | A * | 10/1983 | Cicenas | 285/27 |
| 5,068,494 | A * | 11/1991 | Bolante | 174/654 |
| 5,114,594 | A * | 5/1992 | Rosebrock et al. | 210/767 |
| 5,681,455 | A * | 10/1997 | Takai et al. | 210/154 |
| 6,527,005 | B2 * | 3/2003 | Weaver | 137/312 |
| 6,926,808 | B2 * | 8/2005 | Shen | 202/205 |
| 2003/0024185 | A1 * | 2/2003 | Menzies | 52/219 |

* cited by examiner

*Primary Examiner*—Richard E Chilcot, Jr.
*Assistant Examiner*—James Ference
(74) *Attorney, Agent, or Firm*—Bourque and Associates

(57) ABSTRACT

The present invention relates to a conduit drain for removing liquid condensation in a vertical conduit. Moisture flows down the interior walls of the conduit and collects in a collection lip in the conduit drain. A drain channel is produced around the inner circumference of the conduit drain by the collection lip. The moisture collects within the drain channel and is drawn off into a drain port that is coupled to a drain pipe.

4 Claims, 5 Drawing Sheets

CONDUIT DRAIN

CROSS-REFERENCE TO RELATED APPLICATIONS

The present application claims priority from U.S. provisional patent application Ser. No. 60/660,042, filed Mar. 8, 2005, by Michael Brunt and Wayne Gooderham, incorporated by reference herein and for which benefit of the priority date is hereby claimed.

TECHNICAL FIELD OF THE INVENTION

The present invention relates to a drain for a gas conduit and more particularly, to a drain for removing liquid condensation in a vertical, exhaust gas conduit.

BACKGROUND

Furnaces, hot water heaters and other heating appliances in residential and commercial applications often require conduits to exhaust gas to the exterior of a structure. Air may be drawn from within the structure or air from the exterior of the structure may be drawn through an intake conduit and supplied to the furnace or appliances. In a furnace application, the air may be mixed with a fuel and ignited. Heat may be drawn from the combustion process by way of a heat exchanger and supplied to various parts of the building to heat the interior. The by-products of the combustion process are expelled from the structure by an exhaust conduit. Appliances may use the combustion process to provide mechanical energy or heat energy for residential and commercial applications. Similar to the furnace application, the by-products of the combustion are expelled from the structure by an exhaust conduit.

The combustion process may involve the use of a fuel that has significant moisture content. When the combustion by-products (moisture and the gas) are exhausted through the exhaust conduit, the gas begins to cool and the moisture condenses within the air and collects on the inner walls of the conduit. As the liquid moisture collects, gravity pulls the droplets of moisture down the walls of the conduit and may cause puddles to form at low points or elbows in the conduit.

Traditionally the exhaust conduit is made from rolled or extruded metal or other materials (including plastic) and shaped into cylindrical piping. The temperature differential between the gas and the walls of the conduit results in the condensation of the moisture in the exhaust air. The condensed moisture is corrosive to metal, which leads to corrosion of the exhaust conduit. Over an extended period of time, the corrosion may cause leaks and failure of the conduit to properly exhaust gases to the exterior of the structure.

To aid in the removal of the moisture at elbows, holes have been provided at the bottom point on an elbow to allow the liquid moisture to leak from the conduit. However, the moisture still collects on the interior walls of the conduit and still may run the length of the conduit before exiting the conduit. For example, a two-story building with an exhaust conduit running to the roof of the building will have moisture collect at the top portion of the exhaust conduit. The collected moisture will run the entire length of the conduit and corrode the walls of the conduit until it reaches an elbow or tee in the basement of the building. In addition, the design of the building may not require an elbow in the exhaust conduit. A builder may have to provide unnecessary additional turns to provide an elbow or turn so that a drain can be provided in the exhaust conduit. Therefore, what is needed is a drain for removing liquid condensation in a vertical, exhaust gas conduit.

SUMMARY

The present invention is a novel device, system, and method of manufacture for a conduit drain. An exemplary embodiment, according to the present invention, is a conduit having walls for directing the flow of air in a substantially vertical direction wherein condensation from the air collects on the walls. The conduit may have a collection interior rim extending from the walls of the conduit inward and in a substantially vertical direction. The collection interior rim may provide a condensation collection channel between the walls of the conduit. The conduit may also have a drain port exiting through the conduit walls and located within the condensation collection channel.

In an alternative embodiment, the exemplary conduit drain may have a drain port valve. The drain port valve allows liquids to pass and prevents the passage of gas. In another embodiment the conduit drain may have an outer conduit portion with cylindrical walls adapted to receive an inner exhaust conduit portion. The inner conduit portion may have a fitted portion producing a frictional fit with the walls of the outer exhaust conduit and a collection lip portion having a diameter smaller than the fitting portion and tapering inward to produce the collection lip. In yet another embodiment, a washer may be fitted between the outer conduit portion and the inner conduit portion and located around the fitting portion of the outer conduit portion.

It is important to note that the present invention is not intended to be limited to a device, system, or method which must satisfy one or more of any stated objects or features of the invention. It is also important to note that the present invention is not limited to the exemplary embodiments described herein. Modifications and substitutions by one of ordinary skill in the art are considered to be within the scope of the present invention, which is not to be limited except by the following claims.

BRIEF DESCRIPTION OF THE DRAWINGS

These and other features and advantages of the present invention will be better understood by reading the following detailed description, taken together with the drawings wherein.

DETAILED DESCRIPTION

Figure 1:
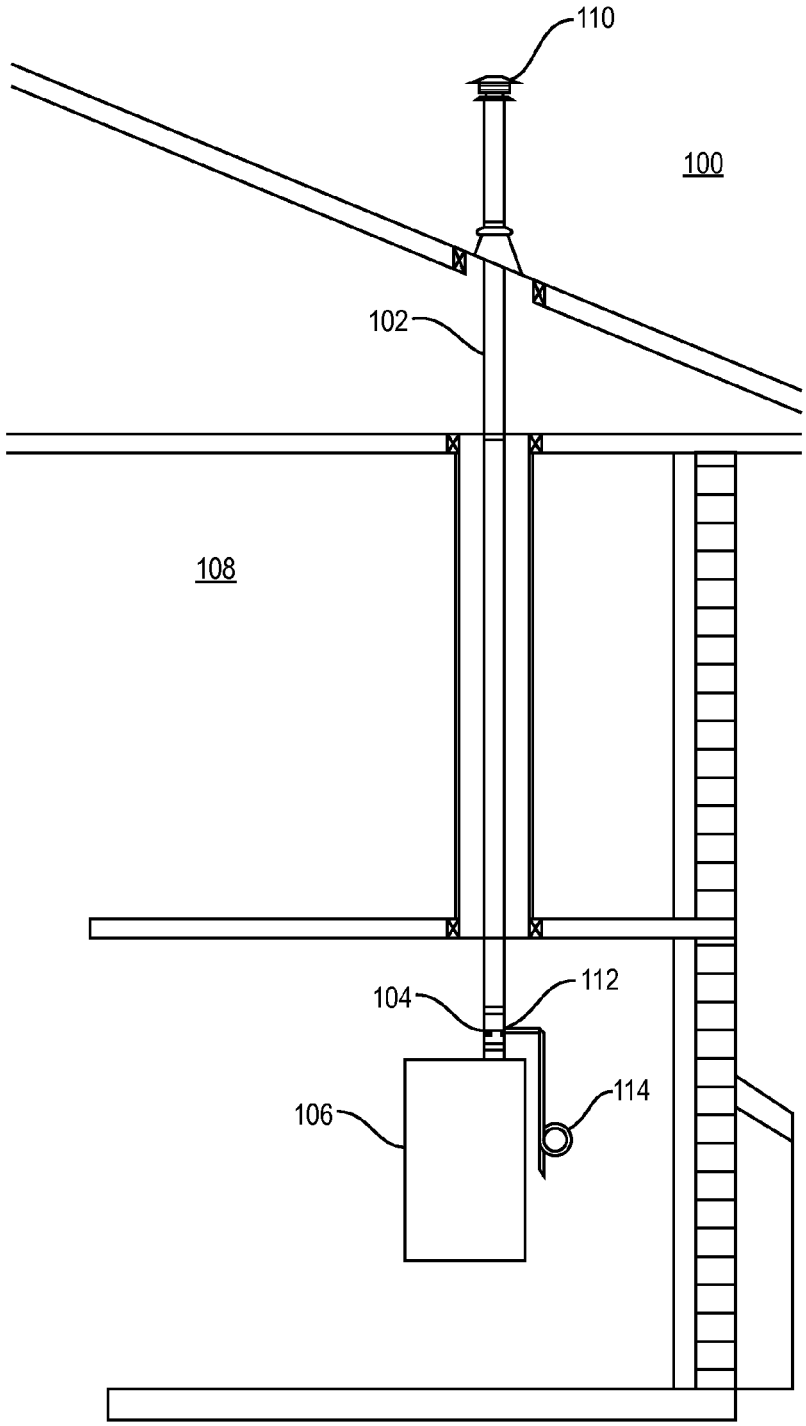
FIG. 1 is a side view of a vertical exhaust gas conduit with a conduit drain system 100 according to an exemplary embodiment of the present invention.

The present invention features a vertical exhaust gas conduit drain 104, FIG. 1, for use in an exhaust gas conduit system 100 according to an exemplary embodiment of the present invention. A vertical exhaust gas conduit 102 runs from the furnace or appliance 106 located in the interior of a building 108, to the exterior of the building 108. Air is drawn from the interior or exterior of the building 108 and mixed with fuel in the furnace or appliance 106. The heated air and combustion by-products exit the furnace or appliance 106 through the exhaust conduit 102 and pass through the conduit drain 104. As the air travels further along the exhaust conduit 102, the air cools and moisture collects on the walls of the exhaust conduit 102. The air exits the exhaust conduit through a cap 110 on the top of the exhaust conduit 102, and mixes with the air at the exterior of the building 108.

The moisture that collects on the interior walls of the exhaust conduit 102 flows down the walls and into the conduit drain 104. The conduit drain 104 collects the liquid from the walls of the exhaust conduit 102 and drains the liquid into a drain pipe 112. The drain pipe 112 may also have a drain trap 114. The drain trap 114 may prevent unwanted components from exiting the drain pipe 112, for example, combustion by-product gases.

Figure 2:
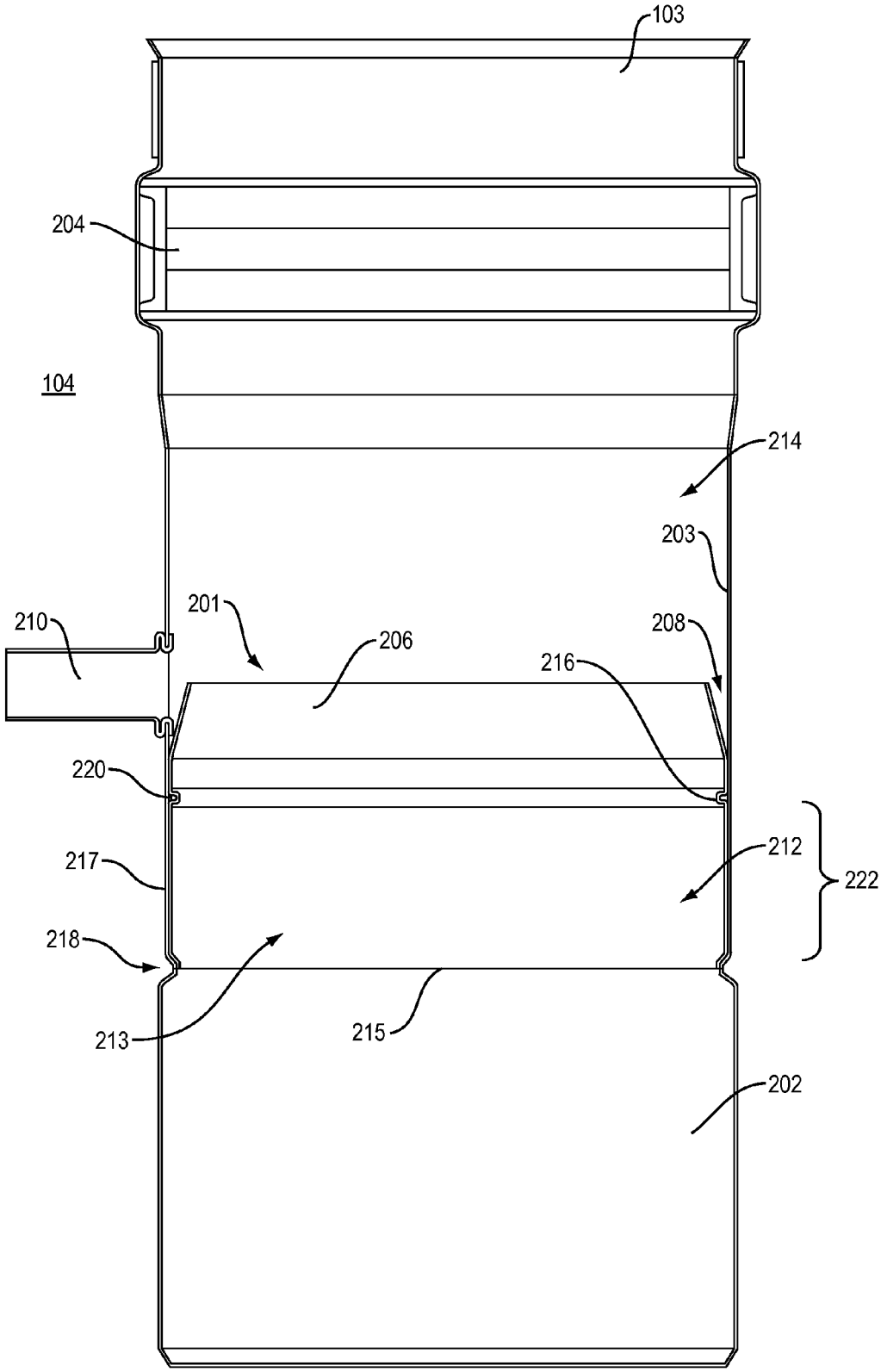
FIG. 2 is a side profile view of the conduit drain 104 according to a first exemplary embodiment of the present invention.

The exhaust conduit 102 according to the first exemplary embodiment couples to the conduit drain 104, FIG. 2, at a coupling proximate an upper region 103 of the outer conduit portion 214. The lower region 202 of the outer conduit portion 214 can be coupled to an exhaust conduit 102 or a gas appliance 106 and can use a variety of devices and methods to couple the conduit drain 104 to an exhaust conduit 102 or a gas appliance 106, for example, but not limited to, a friction fit type coupling, a crimped type coupling or adhesive type fitting. The conduit drain 104 may couple to the exhaust conduit 102 at an upper coupling 204. The upper region coupling 204 may be of similar construction to the lower region coupling 202. The exhaust gas is drawn through the exhaust conduit 102 and exits to the exterior of the building. As moisture from the exhaust gas collects on the interior walls of the exhaust conduit 102 (due to the temperature differential between the exhaust gas and the walls of the conduit), the moisture flows down the walls of the exhaust conduit 102 and collects in a collection lip 206 in the conduit drain 104. A drain channel 208 is produced around the inner circumference of the conduit drain 104 between the inner wall 203 of the outer conduit portion 214 and the collection lip 206. The moisture collects within the drain or collection channel 208 and is drawn off into a drain port 210 that is coupled to a drain pipe 112 (as shown in FIG. 1).

The conduit drain 104 may be made from two pieces of conduit. An inner portion 212 and an outer portion 214 are coupled together to produce the conduit drain 104. The collection lip 206 may be crimped into a top edge or upper region 201 of the inner conduit portion 212. The inner portion 212 may be inserted into the outer portion 214 and coupled together in an engagement area or region 222 in the middle region 217 of the outer conduit portion 214 to produce the conduit drain 104. Examples of couplings may include, but are not limited to, a friction fit type coupling, a crimped type coupling or adhesives. The collection lip may also be made from a ring having a lip or flare, or the like.

Exhaust gas travels through a center region of the conduit drain 102. The collection lip 206 extends inward towards the center of the conduit drain 104. Liquid moisture may travel around the circumference of the conduit drain 104 and exit through the drain port 210. A ratcheting type bracket may be mounted around the outer circumference of the drain conduit 104 in order to provide a friction fit coupling to the exhaust conduit 102. The conduit drain 104 is not limited to a cylindrical shape. A variety of other shaped conduits may be used and are within the scope of the invention. The conduit drain 104 is also not limited to an exhaust conduit. The conduit drain 104 may be implemented in a variety of other conduits and venting devices.

The conduit drain 104 may have a recessed ring portion 216 in and around the circumference of the inner portion 212. Within the recessed ring portion 216, a washer 220 may be inserted to allow the inner portion 212 to provide an airtight and watertight connection between the outer portion 214 and inner portion 212. An additional recess stop 218 may be provided around the circumference of the inner portion 212. The recess stop 218 may provide a stopping point when the inner portion 212 is inserted into the outer portion 214. During assembly, the inner portion 212 may be inserted into the outer portion 214. The inner portion 212 may be pressed upward within the outer portion 214 until the bottom 215 of the outer portion 214 rests against the ridge produced by the recess stop 218. An outer surface of the inner conduit portion 212 may be welded to an inner surface of the outer conduit portion 214, thereby forming a welded region of the inner and outer conduits as shown for example, at 222.

The outer portion 214 and inner portion 212 may be manufactured by shaping or extruding material into the cylindrical conduit or other shaped conduit. A drain port 210 may be provided through the wall of the outer portion 214. The inner portion 212 may be provided with a smaller diameter than the diameter of the outer portion 214. The inner portion 212 may be divided into a fitted portion 213 and the collection lip 206. The collection lip 206 may be produced by tapering the top edge of the inner portion 212. As previously discussed, a recessed ring portion 216 may be provided between the fitted portion 213 and the collection lip 206.

The conduit drain 104 may be assembled by inserting the whole inner portion 212 into the outer portion 214. As previously discussed, the inner portion 212 may be pressed against the recess stop 218. According to the first exemplary assembly, a fitting may be provided on the top and bottom of the outer portion 214 for connecting the conduit drain 104 to a run of conduit 102. The conduit drain 104 may also be assembled by allowing the inner portion 212 to extend from the outer portion 214. According to this exemplary assembly, a fitting may be provided at the top of the outer portion 214 and at the bottom of the inner portion 212. A variety of fittings may be used to connect the conduit drain 104 to a run of conduit 102.

Figure 3:
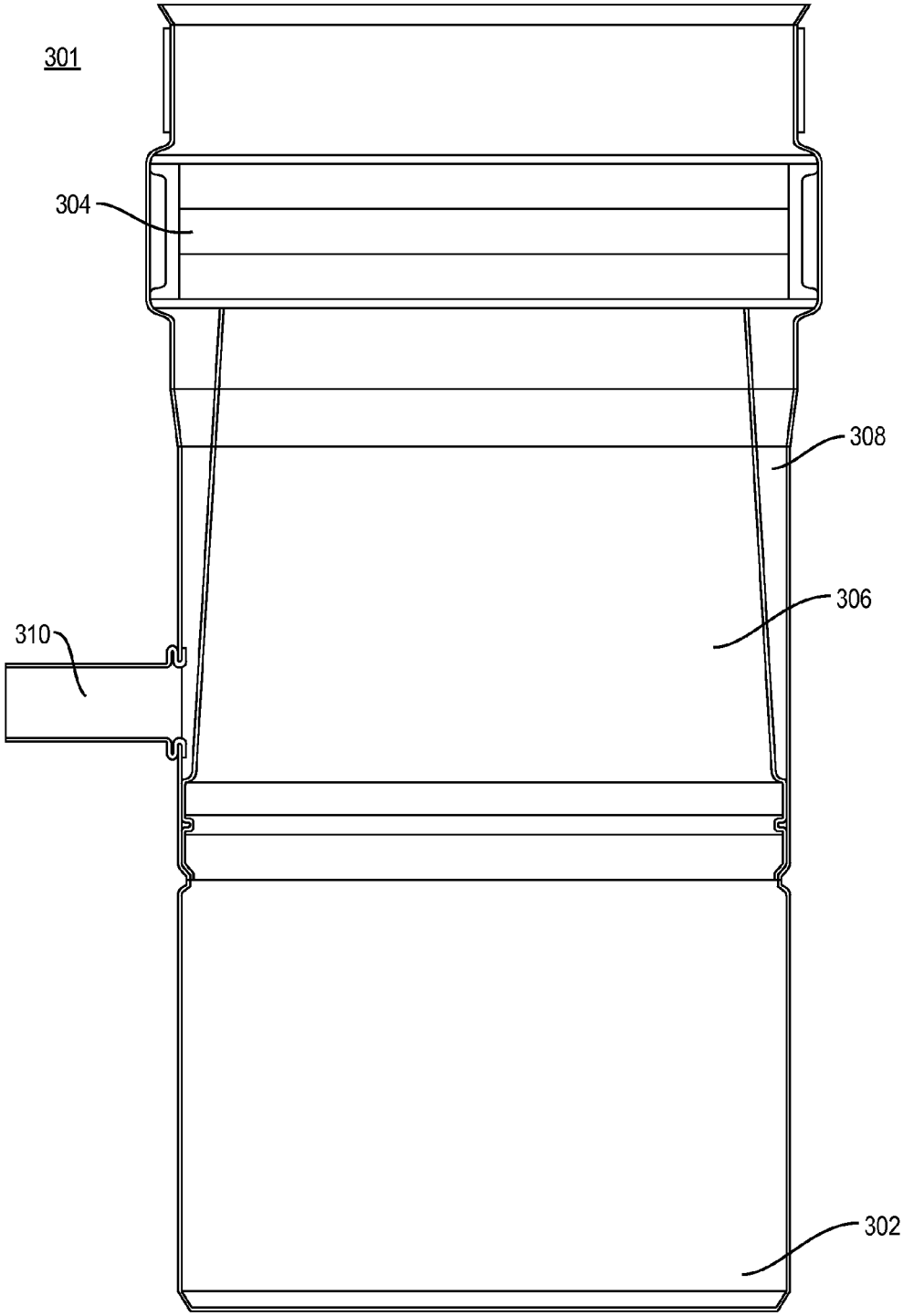
FIG. 3 is a side profile view of the conduit drain 301 according to a second exemplary embodiment of the present invention.

Referring to FIG. 3, the exhaust conduit 102 couples to the conduit drain 301 of the second exemplary embodiment at a lower coupling 302 and an upper coupling 304. The lower coupling 302 and upper coupling 304 may be of similar construction and design to the respective components of the first exemplary embodiment. Moisture from the exhaust gas collects in a collection lip 306 in the conduit drain 301. A drain channel 308 is produced around the inner circumference of the conduit drain 301 by the collection lip 306, as previously described with regard to the first exemplary embodiment.

According to the second embodiment, the collection lip 306 extends a greater distance vertically through the conduit drain 301. The moisture collects within the drain channel 308 and is drawn off into a drain port 310 that is coupled to a drain pipe 112 (as shown in FIG. 1). The increased length of the collection lip 306 may reduce negative pressure due to the flow of exhaust gas and allows for greater collection of moisture. The increased length may also reduce the ability for the condensed moisture to re-evaporate back into the exhaust gas.

Figure 4A:
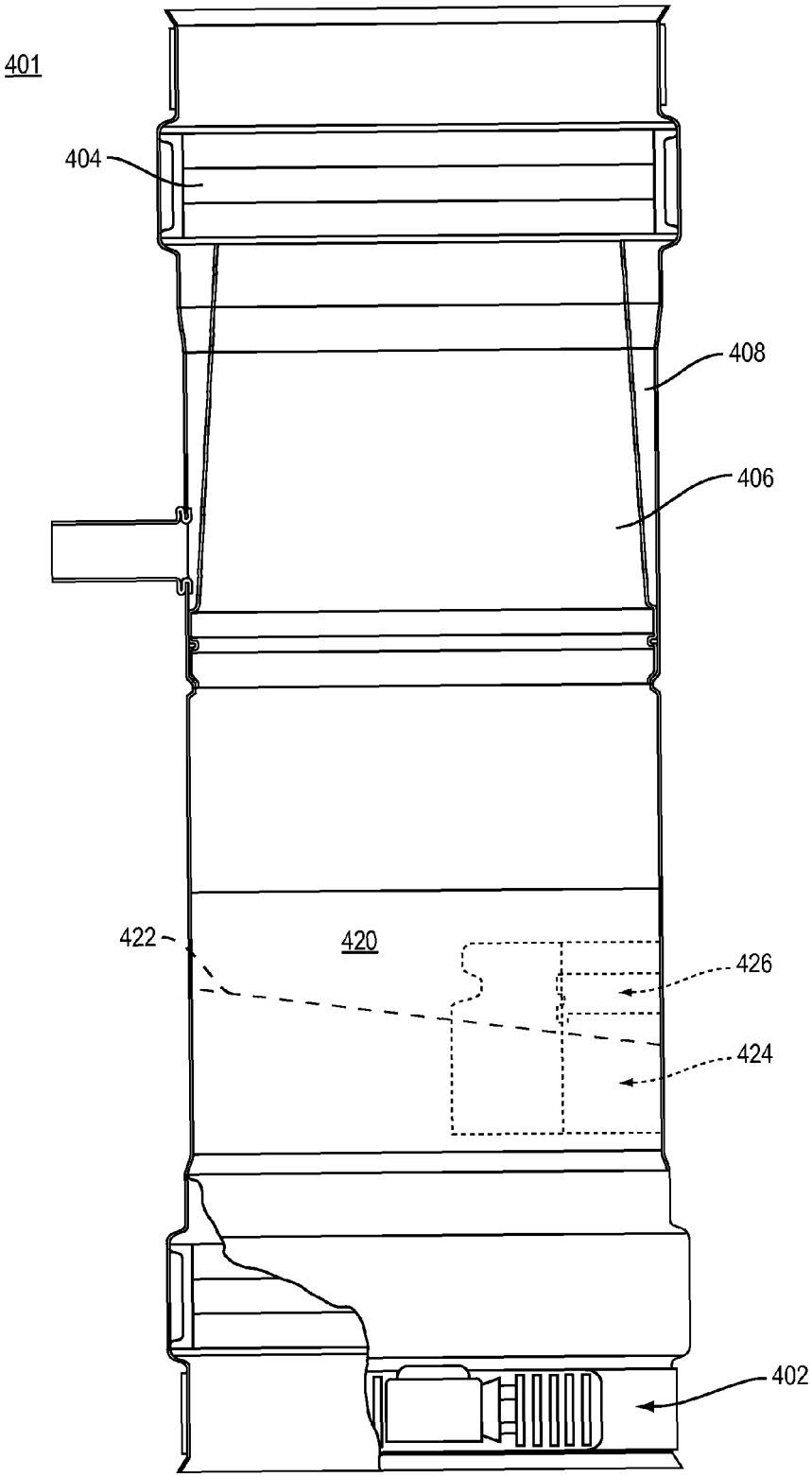
FIG. 4A is a side profile view of the conduit drain 401 according to a third exemplary embodiment of the present invention.
Figure 4B:
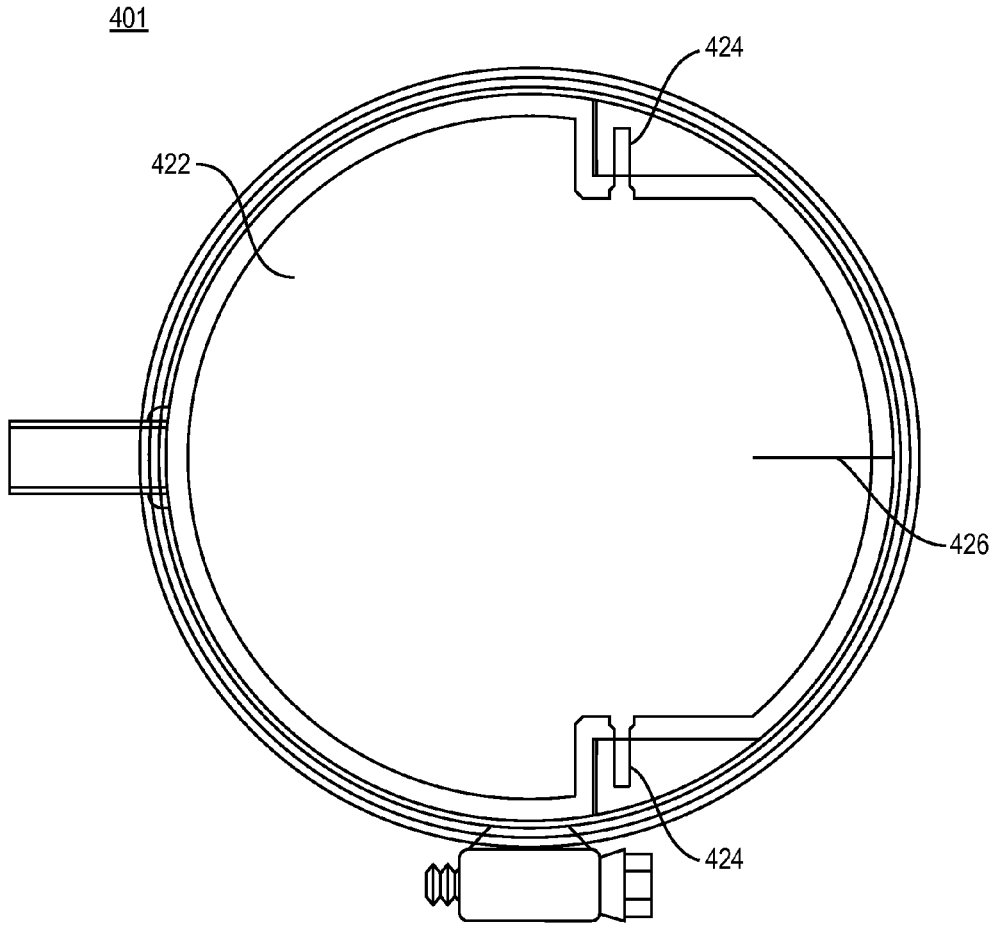
FIG. 4B is a top profile view of the conduit drain 401 according to the third exemplary embodiment of the present invention.

Referring to FIGS. 4A and 4B, the exhaust conduit 102 couples to the conduit drain 401 of the third exemplary embodiment at a lower coupling 402 and an upper coupling 404. The lower coupling 402 and upper coupling 404 may be of similar construction and design to the respective components of the first and second exemplary embodiments. Moisture from the exhaust gas collects in a collection lip 406 in the conduit drain 401. A drain channel 408 is produced around the inner circumference of the conduit drain 401 by the collection lip 406, as previously described with regard to the first exemplary embodiment.

According to the third embodiment, the conduit drain 401 may have a check valve 420 that prevents the flow of air backwards through the exhaust conduit 102. The check valve 420 may be positioned at a location prior to the collection lip 406. The check valve 420 may include a valve plate 422. The valve plate 422 rotatably couples at hinge points 424 to the conduit drain 401. A valve plate stopper 426 prevents the valve plate 422 from rotating and holds the valve plate 422 in a closed position perpendicular to the flow of air. The hinge points 424 allow the valve plate 422 to rotate to an open position located between perpendicular and parallel to the flow of air.

When exhaust air pushes on a bottom surface of the valve plate 422, the valve plate 422 rotates to an open position and allows the exhaust air to flow. When a back draft or other source of pressure pulls air in the wrong direction or there is a lack of pressure on the bottom surface of the valve plate 422, the valve plate 422 rotates to a closed position resting against the valve plate stopper 426. The closed position prevents the flow of air in the wrong direction of the exhaust conduit 102.

The check valve 420 may be positioned within the conduit drain 401 to provide efficient installation. The check valve 420 may also be efficiently manufactured in combination with the conduit drain 401. The hinge points 424 and the valve plate stopper 426 may be constructed, for example, by attaching additional material to the conduit drain 401 by weld, rivet, or other coupling device. The hinge points 424 and the valve plate stopper 426 may also be produced from the walls of the conduit by forming or bending the walls. The valve plate 422 may be inserted providing an efficient construction of both a moisture drain and a check valve to the exhaust conduit 104.

Other modifications and substitutions by one of ordinary skill in the art are also considered to be within the scope of the present invention.

The invention claimed is:

1. A condensation drain for an exhaust gas conduit pipe, said condensation drain comprising:

an exhaust gas condensation conduit drain having essentially parallel cylindrical walls, for directing the flow of exhaust gas phase material from a gas appliance through said exhaust gas condensation conduit drain, wherein condensation from the exhaust gas phase material passing through said exhaust gas condensation conduit drain collects on the essentially cylindrical parallel walls of the exhaust gas condensation conduit drain;

said exhaust gas condensation conduit drain having an outer conduit portion with essentially parallel cylindrical walls with a length and having an exterior diameter, wherein said exterior diameter is essentially the same throughout the length of the outer conduit portion and having an interior diameter that is essentially the same throughout the length of the outer conduit portion, said outer conduit portion having an upper region, a lower region and a middle region, said upper region configured for coupling said exhaust gas condensation conduit drain to an exhaust gas conduit pipe, said middle region configured to completely receive an inner conduit portion, said inner conduit portion having a length, said inner conduit portion fully disposed within said essentially parallel cylindrical walls of said outer conduit portion, said inner conduit portion having essentially parallel cylindrical walls that are generally the same diameter along the entire length of the inner conduit portion, and having an outer diameter which is slightly less than the interior diameter of the said outer conduit portion;

said inner conduit portion having an engagement region configured for producing a frictional fit with said essentially parallel cylindrical walls of said outer conduit portion, said engagement region including a recessed ring portion, said recessed ring portion further including a washer disposed in said recessed ring portion;

a recess stop disposed in said inner conduit portion, said recess stop forming an inwardly protruding ridge on an interior cylindrical wall portion of said inner conduit portion, wherein said recess stop is configured to provide a stopping point when said inner conduit portion of said exhaust gas condensation conduit drain is coupled to one of an exhaust gas conduit pipe or a gas appliance;

said inner conduit portion including a collection lip disposed in an upper region of said inner conduit portion, said collection lip tapering inwardly away from said inner wall of said outer conduit portion of said exhaust gas condensation conduit drain, and configured to produce a collection channel between the inner wall of said outer portion of the exhaust gas condensation conduit drain and the collection lip, for collecting exhaust gas condensation from the interior walls of said exhaust gas conduit pipe and said exhaust gas condensation conduit drain, said collection lip having a diameter that is less than said diameter of said inner wall of said outer conduit portion; and a drain port, disposed in said middle region of said outer conduit portion and fluidly coupled to said collection channel, and configured for receiving exhaust gas condensation from said collection channel.

2. The drain for a conduit of claim 1, further comprising a drain port valve wherein the valve allows liquids to pass and prevents the passage of gas.

3. The drain for a conduit of claim 1, wherein the engagement region of the inner conduit portion is permanently coupled to the outer conduit portion.

4. The drain for a conduit of claim 1, wherein the exhaust conduit runs in a substantially vertical direction.

* * * * *